US006638061B1

(12) United States Patent
Cain et al.

(10) Patent No.: US 6,638,061 B1
(45) Date of Patent: Oct. 28, 2003

(54) LOW NOX COMBUSTION METHOD AND APPARATUS

(75) Inventors: Bruce E. Cain, Akron, OH (US); Thomas F. Robertson, Medina Township, OH (US); John N. Newby, Lexington, KY (US)

(73) Assignee: North American Manufacturing Company, Cleveland, OH (US)

( * ) Notice: Subject to any disclaimer, the term of this patent is extended or adjusted under 35 U.S.C. 154(b) by 5 days.

(21) Appl. No.: 10/218,122

(22) Filed: Aug. 13, 2002

(51) Int. Cl.[7] ..... F27B 15/00

(52) U.S. Cl. ..... 432/14; 432/17; 432/19; 432/133

(58) Field of Search ..... 432/14, 17, 19, 432/36, 128, 133; 431/8, 10, 350, 352

(56) References Cited

U.S. PATENT DOCUMENTS 3,159,345 A 12/1964 Osburn, Jr. et al.
3,734,675 A 5/1973 Osburn
3,814,570 A 6/1974 Guigues et al.
4,004,875 A 1/1977 Zink et al.

(List continued on next page.)

OTHER PUBLICATIONS

National Project Reports High Performance Industrial Furnace Development Project High Temperature Air Combustion, Mar. 20, 1997, The Japan Industrial Furnace Manufacturers Association.

*Primary Examiner*—Jiping Lu
(74) *Attorney, Agent, or Firm*—Jones Day

(57) ABSTRACT

Primary fuel and preheated oxidant are injected into a combustion zone to produce a flame with a predetermined adiabatic flame temperature. The preheated oxidant is injected at a target rate of oxidant injection. The primary fuel is injected at a first reduced rate which is less than a corresponding target rate of fuel injection. Secondary fuel is simultaneously injected into the combustion zone separately from the flame at a second reduced rate which is equal to the difference between the first reduced rate and the target rate of fuel injection. In this manner, combustion of the fuel with the preheated oxidant provides the amount of heat expected from the target rates of injection, while maintaining an adiabatic flame temperature that is lower than it might otherwise be if the target rate of fuel injection were provided entirely at the flame. The lower adiabatic flame temperature provides a correspondingly lower rate of NOx production.

14 Claims, 2 Drawing Sheets

U.S. PATENT DOCUMENTS 4,111,637 A 9/1978 Hillman, II
4,378,205 A 3/1983 Anderson
4,395,223 A * 7/1983 Okigami et al. ..... 431/10
4,427,371 A 1/1984 Unks
4,445,842 A 5/1984 Syska
4,474,121 A 10/1984 Lewis
4,496,306 A 1/1985 Okigami et al.
4,576,570 A 3/1986 Adams et al.
4,588,372 A 5/1986 Torborg
4,629,413 A 12/1986 Michelson et al.
4,798,531 A 1/1989 Breckner
4,884,967 A 12/1989 Meyer
4,927,351 A 5/1990 Hagar et al.
4,945,841 A 8/1990 Nakamachi et al.
4,960,059 A 10/1990 Berkau et al.
5,135,387 A 8/1992 Martin et al.
5,154,599 A 10/1992 Wunning
5,195,884 A 3/1993 Schwartz et al.
5,201,650 A 4/1993 Johnson
5,263,849 A 11/1993 Irwin et al.
5,263,850 A 11/1993 Walker
5,310,337 A 5/1994 Lifshits et al.
5,310,338 A 5/1994 Harding
5,327,718 A 7/1994 Iwata et al.
5,407,345 A 4/1995 Robertson et al.
5,413,477 A 5/1995 Moreland
5,554,021 A 9/1996 Robertson et al.
5,605,452 A 2/1997 Robertson et al.
5,667,376 A 9/1997 Robertson et al.
5,756,059 A 5/1998 Zamansky et al.
5,813,846 A 9/1998 Newby et al.
5,846,067 A * 12/1998 Nishiyama et al. ..... 431/115
5,873,959 A 2/1999 Schurko et al.
6,123,542 A 9/2000 Joshi et al.
6,210,151 B1 4/2001 Joshi et al.
6,276,924 B1 8/2001 Joshi et al.
6,290,492 B1 9/2001 Li et al.

* cited by examiner

LOW NOX COMBUSTION METHOD AND APPARATUS

FIELD OF THE INVENTION

The present invention relates to furnaces in which fuel and oxidant are injected into a combustion zone.

BACKGROUND

A combustion furnace generates heat by the combustion of fuel with an oxidant. The fuel is typically natural gas, and the oxidant is typically air, vitiated air, oxygen, or air enriched with oxygen. These reactants are injected into a combustion zone within the furnace. Combustion of the fuel and oxidant in the combustion zone causes oxides of nitrogen to result from the combination of oxygen and nitrogen. It is sometimes desirable to reduce the production of NOx.

SUMMARY OF THE INVENTION

The invention provides a method and apparatus for injecting fuel and preheated oxidant into a combustion zone at target rates of injection.

In accordance with the method, primary fuel and preheated oxidant are injected into the combustion zone to produce a flame with a predetermined adiabatic flame temperature. The preheated oxidant is injected at the target rate of oxidant injection. However, the primary fuel is injected at a first reduced rate which is less than the target rate of fuel injection. Secondary fuel is simultaneously injected into the combustion zone separately from the flame at a second reduced rate which is equal to the difference between the first reduced rate and the target rate of fuel injection. In this manner, the invention enables combustion of the fuel with the preheated oxidant to provide the amount of heat expected from the target rates of injection, while maintaining an adiabatic flame temperature that is lower than it might otherwise be if the target rate of fuel injection were provided entirely at the flame. The lower adiabatic flame temperature provides a correspondingly lower rate of NOx production.

The apparatus includes a controller which is operative to receive an input indicative of the temperature of the preheated oxidant. The controller responds to the temperature input by identifying an oxidant-to-fuel ratio at which combustion of the fuel with the preheated oxidant can occur at the predetermined adiabatic flame temperature. The value of the preheated oxidant in the identified ratio is equal to the target rate of oxidant injection. The value of the fuel in the identified ratio is a first reduced rate which is less than the target rate of fuel injection. Additionally, the controller is further operative in response to the temperature input to determine a second rate of fuel injection which is equal to the difference between the first reduced rate and the target rate of fuel injection.

Further in accordance with the invention, the apparatus includes a device which is operative to sense the temperature of the preheated oxidant, and a reactant supply system which is operative in response to the controller to inject the primary fuel and the preheated oxidant into the combustion zone at the identified ratio to produce the flame with the predetermined adiabatic flame temperature. The reactant supply system simultaneously injects secondary fuel into the combustion zone separately from the flame at the second reduced rate. Preferably, the reactant supply system injects the primary fuel and the preheated oxidant into the combustion zone together as fuel lean premix, and injects the secondary fuel into the combustion zone at a plurality of separate locations. The second reduced rate is the sum of the rates at which the secondary fuel is injected at the separate locations.

DESCRIPTION

Figure 1:
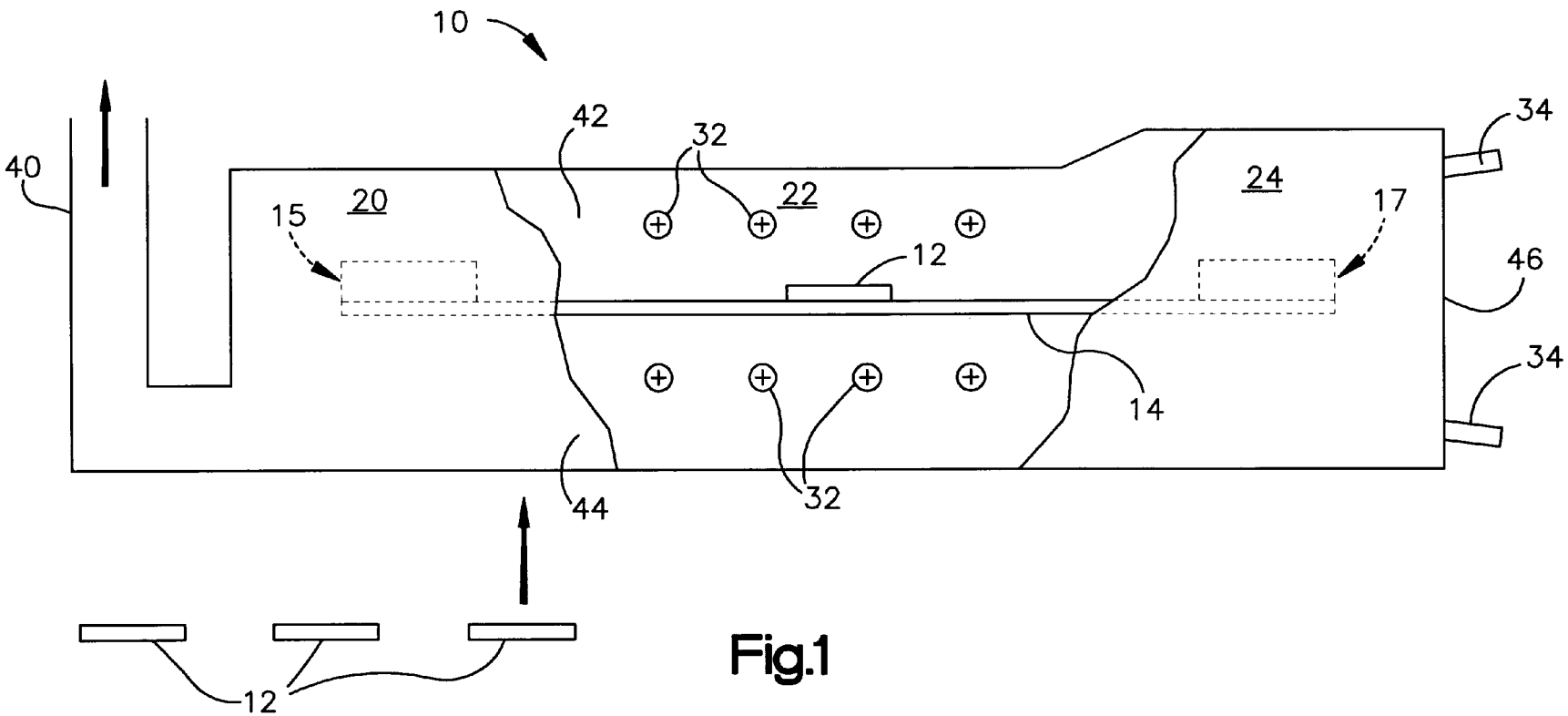
FIG. 1 is a schematic view of a combustion furnace.

The apparatus 10 shown schematically in FIG. 1 is a combustion furnace having parts which, as described below, are examples of the elements recited in the claims. This particular combustion furnace 10 is a steel reheat furnace for raising unheated steel articles 12, such as billets, ingots, slabs, or the like, to an elevated process temperature.

A conveyor 14 carries the steel articles 12 through the furnace 10 from an inlet opening 15 to an outlet opening 17. The conveyor 14 can be a pusher, a walking beam, or any other suitable conveyor known in the art. The steel articles 12 are thus carried through multiple zones within the furnace 10, including a preheat zone 20, a heat zone 22, and a soak zone 24. The zones 20, 22 and 24 are heated to successively higher temperatures by burner assemblies 32 and 34 that fire into the heat zone 22 and the soak zone 24, respectively. These temperatures may be, for example, 2000° F. in the preheat zone 20, 2400° F. in the heat zone 22, and 2450° F. in the soak zone 24. The steel articles 12 are heated thoroughly to the temperature of the soak zone 24 before emerging from the outlet opening 17.

As further shown schematically in FIG. 1, the furnace 10 has a flue 40 through which flue gasses are exhausted from the furnace 10. Products of combustion flow from the burner assemblies 32 and 34 in a process stream that moves through the furnace 10 toward the flue 40 in a direction from right to left, as viewed in FIG. 1, while the steel articles 12 move oppositely through the furnace 10 from left to right.

The burner assemblies 32 at the heat zone 22 are mounted in the opposite side walls 42 and 44 of the furnace 10. These burner assemblies 32 are oriented to fire into the heat zone 22 in directions extending across the conveyor path taken by the steel articles 12, and are arranged in rows above and below the conveyor path. The burner assemblies 34 at the soak zone 24 are mounted in an end wall 46 of the furnace 10 and are oriented to fire into the soak zone 24 in directions generally parallel to the conveyor path. Those burner assemblies 34 also are arranged in rows above and below the conveyor path, with the first burner assembly 34 in each row being shown schematically in FIG. 1.

The heat zone 22 and the soak zone 24 may have differing heating demands that require the burner assemblies 32 and 34 to have correspondingly different heating capacities. However, all of the burner assemblies 32 and 34 preferably have the common features shown schematically in FIG. 2 with reference to one of the burner assemblies 32 at the side wall 42. For example, each of the burner assemblies 32 and 34 includes at least one mixer tube 50 and a plurality of fuel injectors 52. The single mixer tube 50 shown in FIG. 2 has a longitudinal central axis 57, and has an open end 58 that communicates with the heat zone 22 through a generally conical burner tile 60. If more than one mixer tube 50 were included in the burner assembly 32, the mixer tubes 50 would preferably be arranged in a circular array concentric with the burner tile 60. Each fuel injector 52 has an open end 62 which defines a fuel inlet to the heat zone 22 at a location spaced radially outward from the burner tile 60. There are preferably three of the fuel injectors 52 in the burner assembly 32, two of which are shown in the sectional view of FIG. 2, with the fuel inlets 62 equally spaced apart from each other in a circular array centered on the axis 57.

Figure 2:
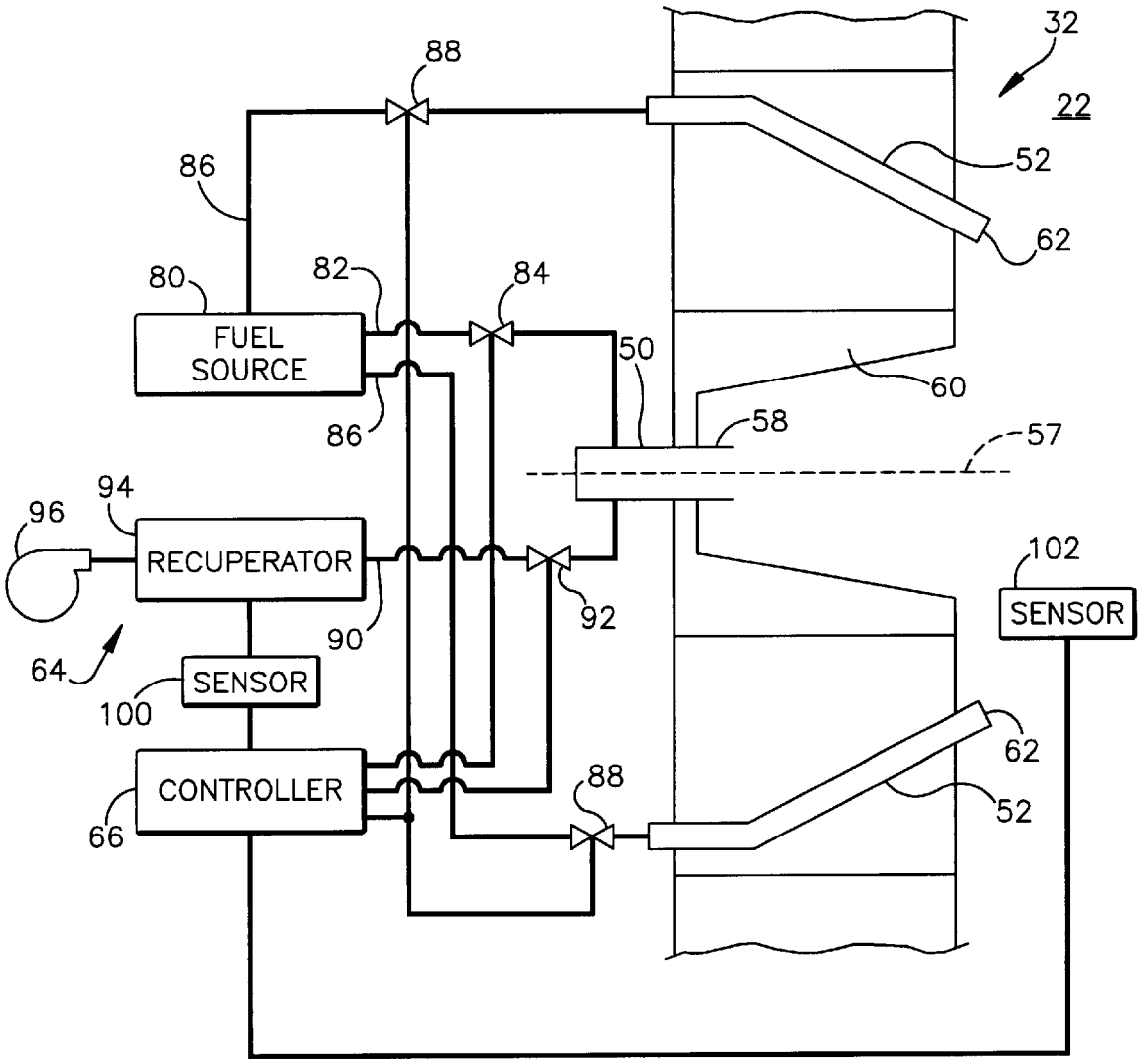
FIG. 2 is a schematic view of parts of the furnace of FIG. 1.

As further shown schematically in FIG. 2, the furnace 10 is equipped with a reactant supply system 64 and a controller 66 that controls the reactant supply system 64. The burner assemblies 32 and 34 are operatively connected with the controller 66 as parts of the reactant supply system 64. When the burner assembly 32 fires into the heat zone 22, it projects a flame into the heat zone 22 along the axis 57. The flame originates upon ignition of a premix of primary fuel and oxidant that emerges from the open end 58 of the mixer tube 50. If the burner assembly 32 were provided with multiple mixer tubes 50, the multiple mixer tubes 50 would together project a single flame through the burner tile 60 in a similar manner. Secondary fuel is injected from the fuel inlets 62 into the heat zone 22 separately from the flame. The reactant supply system 64 operates in response to the controller 66 to deliver primary fuel, secondary fuel, and oxidant at rates that enable the burner assembly 32 to provide the appropriate amount of heat to the corresponding zone 22 of the furnace 10.

The reactant supply system 64 has a plurality of lines and valves that communicate a fuel source 80 with the burner assembly 32. These include a primary fuel line 82 with a primary fuel valve 84, and secondary fuel lines 86 with secondary fuel valves 88. The primary fuel valve 84 is shiftable to regulate a flow of primary fuel from the source 80 to the mixer tube 50. Each of the secondary fuel valves 88 is shiftable to regulate a flow of secondary fuel from the source 80 to a respective fuel injector 52. In an alternative arrangement, all of the fuel injectors 52 in the burner assembly 32 could be connected in parallel downstream of a common secondary fuel valve 88. Natural gas is preferred for both the primary fuel and the secondary fuel.

Other parts of the reactant supply system 64 include an oxidant line 90 and an oxidant valve 92 which is shiftable to regulate a flow of oxidant from a source to the mixer tube 50. In this example the oxidant is air. Accordingly, the source of oxidant includes an air preheater, such as a recuperator 94, which receives a flow of air from a blower 96. The recuperator 94 is coupled to the flue 40 (FIG. 1) to preheat the air before it is delivered to the mixer tube 50. Although each mixer tube 50 may have a respective individual oxidant valve 92, two or more of the mixer tubes 50 may be connected with the recuperator 94 in parallel downstream of a common oxidant valve 92. A common fuel valve 84 also could be provided for parallel mixer tubes 50 as an alternative to respective individual fuel valves 84. Such a parallel arrangement would be preferred for the mixer tubes 50 in each row of burner assemblies 32 and 34 shown in FIG. 1.

The controller 66 is operatively interconnected with the valves 84, 88 and 92 in the reactant supply system 64, and also with a pair of temperature sensors 100 and 102. In this arrangement, the controller 66 operates the valves 84, 88 and 92 such that combustion in the heat zone 22 occurs within a predetermined temperature range. Specifically, the first temperature sensor 100 has an output indicative of the temperature of the preheated air. The second temperature sensor 102 has an output indicative of the temperature of the furnace zone 22 into which the burner assembly 32 is firing. These are input to the controller 66. The controller 66 responds by determining a ratio of injection rates at which the preheated air and primary fuel in the premix will produce an adiabatic flame temperature within a predetermined range, and operates the valves 84 and 92 accordingly.

When the controller 66 determines the ratio of preheated air and primary fuel injection, it does so with reference to target rates of air and fuel injection that correspond to the amount of heat that is called for by the steel articles 12 (FIG. 1) to be heated in the heat zone 22. Since all of the air is provided at the mixer tube 50, the ratio of preheated air to fuel injection at the mixer tube 50 includes the target rate of air injection. The controller 66 thus directs the valve 92 to inject the preheated air at the target rate. However, the fuel is injected separately as primary fuel at the mixer tube 50 and secondary fuel at the fuel injectors 52. The target rate of fuel injection is therefore split between the mixer tube 50 and the fuel injectors 52. The ratio of air-to-fuel injection at the mixer tube 50 thus includes a rate of fuel injection that is less than the target rate, i.e., a first reduced rate of fuel injection. In order to meet the target rate of fuel injection, the secondary fuel is injected at the fuel inlets 62 at rates which together provide a second reduced rate equal to the difference between the target rate and the first reduced rate. This enables the burner assembly 32 to fire into the heat zone 22 with the target rates of air and fuel injection in order to provide the desired amount of heat, while maintaining an adiabatic flame temperature in a range that is lower than it might otherwise be if the target rate of fuel injection were provided entirely at the flame. Combustion at the lower adiabatic flame temperature produces a correspondingly lesser amount of NOx production.

As an example of the foregoing method of operation, a heating process may have target rates of air and fuel injection of, for example, 1,100 scf/h of air injection and 100 scf/h of fuel injection. The temperature of the preheated air could be, for example, 700° F. The desired adiabatic flame temperature could be within a predetermined range, such as about 2,200° F. to about 2,700° F., or may have a more specific predetermined value, such as 2,500° F. The controller 66 will determine the air-to-fuel injection ratio at which combustion of the fuel with air at 700° F. will provide an adiabatic flame temperature of 2,500° F. This ratio might be, for example, 20 to 1. The controller 66 will then direct the oxidant valve 92 to provide the mixer tube 50 with the target rate of 1,100 scf/h of air, and will direct the primary fuel valve 84 to provide the mixer tube 50 with 55 scf/h of fuel. The value of 55 scf/h of fuel injection is one twentieth the amount of air injection in accordance with the ratio determined by the controller 66. This is the first reduced rate of fuel injection. The second reduced rate of fuel injection is then determined by the controller 66 to be 45 scf/h of fuel, which is equal to the difference between the target rate of 100 scf/h and the first reduced rate of 55 scf/h. Adjustments can be made by the controller 66 in response to air temperature changes indicated by the output of the first temperature sensor 100, as well as in response to actual furnace temperatures indicated by the output of the second temperature sensor 102.

This written description uses examples to disclose the invention, including the best mode, and also to enable a person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The claimed invention is:

1. A method of injecting fuel and preheated oxidant into a combustion zone at target rates, said method comprising:

injecting primary fuel and the preheated oxidant into the combustion zone to produce a flame with a predetermined adiabatic flame temperature, with the preheated oxidant being injected at the target rate of oxidant injection and the primary fuel being injected at a first reduced rate which is less than the target rate of fuel injection; and simultaneously injecting secondary fuel into the combustion zone separately from the flame at a second reduced rate equal to the difference between the first reduced rate and the target rate of fuel injection.

2. A method as defined in claim 1 wherein the primary fuel and the preheated oxidant are injected together as fuel lean premix.

3. A method as defined in claim 1 wherein the secondary fuel is injected into the combustion zone at a plurality of separate locations, and the second reduced rate is the sum of the rates at which the secondary fuel is injected at the separate locations.

4. A method as defined in claim 3 wherein the separate locations are within a steel reheat furnace.

5. A method as defined in claim 3 wherein the separate locations are circumferentially spaced from each other in a circular array.

6. A method as defined in claim 1 wherein the first reduced rate is the quotient of the target rate of oxidant injection and an oxidant-to-fuel ratio at which combustion of the fuel with the preheated oxidant can occur at the predetermined adiabatic flame temperature.

7. A method as defined in claim 1 wherein the adiabatic flame temperature is within the range of about 2,200° F. to about 2,700° F.

8. An apparatus for use in injecting fuel and preheated oxidant into a combustion zone at target rates, said apparatus comprising:

a controller which is operative to receive an input indicative of the temperature of the preheated oxidant, and to respond to said input by identifying an oxidant-to-fuel ratio at which combustion of the fuel with the preheated oxidant can occur at a predetermined adiabatic flame temperature, with the value of the preheated oxidant in said identified ratio being equal to the target rate of oxidant injection, and the value of the fuel in said identified ratio being a first reduced rate which is less than the target rate of fuel injection;

said controller being further operative in response to said input to determine a second reduced rate of fuel injection equal to the difference between the first reduced rate and the target rate of fuel injection.

9. An apparatus as defined in claim 8 further comprising a recuperator and a temperature sensor operatively connected with said controller to provide said input.

10. An apparatus for injecting fuel and preheated oxidant into a combustion zone at target rates, said apparatus comprising:

a device which is operative to sense the temperature of the preheated oxidant;

a controller which is operative in response to said device to identify an oxidant-to-fuel ratio at which combustion of the fuel with the preheated oxidant can occur at a predetermined adiabatic flame temperature; and a reactant supply system which is operative in response to said controller to inject primary fuel and the preheated oxidant into the combustion zone at the identified ratio to produce a flame with the predetermined adiabatic flame temperature, with the preheated oxidant being injected at the target rate of oxidant injection and the fuel being injected at a first reduced rate which is less than the target rate of fuel injection;

said reactant supply system being further operative in response to said controller to simultaneously inject secondary fuel into the combustion zone separately from the flame at a second reduced rate equal to the difference between the first reduced rate and the target rate of fuel injection.

11. An apparatus as defined in claim 10 wherein said reactant supply system is operative in response to said controller to inject the primary fuel and the preheated oxidant together as fuel lean premix.

12. An apparatus as defined in claim 10 wherein said reactant supply system is operative in response to said controller to inject the secondary fuel into the combustion zone separately from the flame at a plurality of separate locations, with the second reduced rate being the sum of the rates at which the secondary fuel is injected at said separate locations.

13. An apparatus as defined in claim 12 wherein said separate locations are within a steel reheat furnace.

14. An apparatus as defined in claim 12 wherein said separate locations are circumferentially spaced from each other in a circular array.

* * * * *